United States Patent [19]

Berner et al.

[11] Patent Number: 4,566,440

[45] Date of Patent: Jan. 28, 1986

[54] ORTHOSIS FOR LEG MOVEMENT WITH VIRTUAL HIP PIVOT

[75] Inventors: John M. Berner, Golden Valley; Patricia M. Derus, Osseo; James P. Berner, Richfield, all of Minn.

[73] Assignee: Empi, Inc., Fridley, Minn.

[21] Appl. No.: 578,731

[22] Filed: Feb. 9, 1984

[51] Int. Cl.[4] ..... A61H 1/02

[52] U.S. Cl. ..... 128/25 R

[58] Field of Search ..... 128/25 R, 25 B, 80 R, 128/88, 24 R

[56] References Cited

U.S. PATENT DOCUMENTS

| | | | |
|---|---|---|---|
| 2,681,650 | 6/1954 | Goss | 128/33 |
| 2,682,401 | 6/1954 | Curtis | 272/58 |
| 2,716,980 | 9/1955 | Bierman | 128/44 |
| 2,763,261 | 9/1956 | Masmonteil et al. | 128/25 R |
| 3,062,204 | 11/1962 | Stefano | 272/73 |
| 3,071,130 | 1/1963 | Hoyer et al. | 128/25 |
| 3,089,692 | 5/1963 | Blomqvist | 128/24 R |
| 3,212,776 | 10/1965 | Bassler | 272/73 |
| 3,323,518 | 6/1967 | Swanson | 120/25 |
| 3,450,132 | 6/1969 | Ragon et al. | 128/25 |
| 3,478,744 | 11/1969 | Leiter | 128/303.14 |
| 3,503,082 | 3/1970 | Kerwit | 5/67 |
| 3,580,244 | 5/1971 | Graves | 128/25 A |
| 3,612,042 | 10/1971 | Fry | 128/25 R |
| 3,616,795 | 11/1971 | Powlan | 128/85 |
| 3,661,149 | 5/1972 | Ferries | 128/25 R |
| 3,661,150 | 5/1972 | Peterssen et al. | 128/85 |
| 3,683,897 | 8/1972 | Shield et al. | 128/25 R |
| 3,695,255 | 10/1972 | Rodgers et al. | 128/25 B |
| 3,717,144 | 2/1973 | Bimler | 128/80 A |
| 3,730,174 | 5/1973 | Madison | 128/25 R |
| 3,742,940 | 7/1973 | Phiffer | 128/25 R |
| 3,754,547 | 8/1973 | Walker | 128/25 R |
| 3,765,411 | 10/1973 | Ward, Jr. | 128/84 C |
| 3,789,836 | 2/1974 | Girten | 128/25 B |
| 3,800,787 | 4/1974 | Rush | 128/75 |
| 3,878,842 | 4/1975 | Goldberg | 128/84 C |
| 3,917,261 | 11/1975 | Small et al. | 272/57 D |
| 3,930,495 | 1/1976 | Marino, Jr. | 128/25 R |
| 3,976,057 | 8/1976 | Barclay | 128/25 R |
| 4,003,374 | 1/1977 | Mizrachy | 128/48 |
| 4,151,839 | 5/1979 | Schwarz | 128/52 |
| 4,185,622 | 1/1980 | Swenson | 128/25 B |
| 4,214,577 | 7/1980 | Hoy | 128/25 R |
| 4,282,865 | 8/1981 | Pogue | 128/25 R |
| 4,284,157 | 8/1981 | Lay | 180/65 R |
| 4,323,060 | 4/1982 | Pecheux | 128/84 R |

FOREIGN PATENT DOCUMENTS

| | | | |
|---|---|---|---|
| 297482 | 8/1915 | Fed. Rep. of Germany . | |
| 0848027 | 7/1981 | U.S.S.R. | 128/25 R |

*Primary Examiner*—Richard J. Apley
*Assistant Examiner*—Kathleen D'Arrigo
*Attorney, Agent, or Firm*—Kinney & Lange

[57] ABSTRACT

A leg exercise orthosis supports the leg of a patient while causing movement of the hip, knee, and ankle joints. The apparatus includes a frame; a femur support; a tibia support which is pivotally connected to the femur support; a double four-bar linkage which connects the frame, the femur support, and the tibia support; and a drive motor connected to the double four-bar linkage. As it is driven by the drive motor, the double four bar linkage guides motion of the femur and tibia supports so that femur support pivots about a virtual pivot axis which essentially corresponds to the pivot axis of the hip joint of the leg.

20 Claims, 14 Drawing Figures

12
12A
12B
12C
12D
12E
12F
10
14
16
18
20
22
26
28
30A
30A'
30B
30B'
32
34
36
38A
38B
40A
40B
42A
42B
44A
44B
48
52
60A
62
64A
64B
66
68
70A
72A
72B
74A
74B
76A
76B
78A
78B
80A
80B
82A
82B
90A
94A
98A
180
182
184
186
188
190
191
192
193
194
196
200
202
204
208A
208B
210A
212
214
216
218
220
222
226
228
230
232
246
270
272
274A

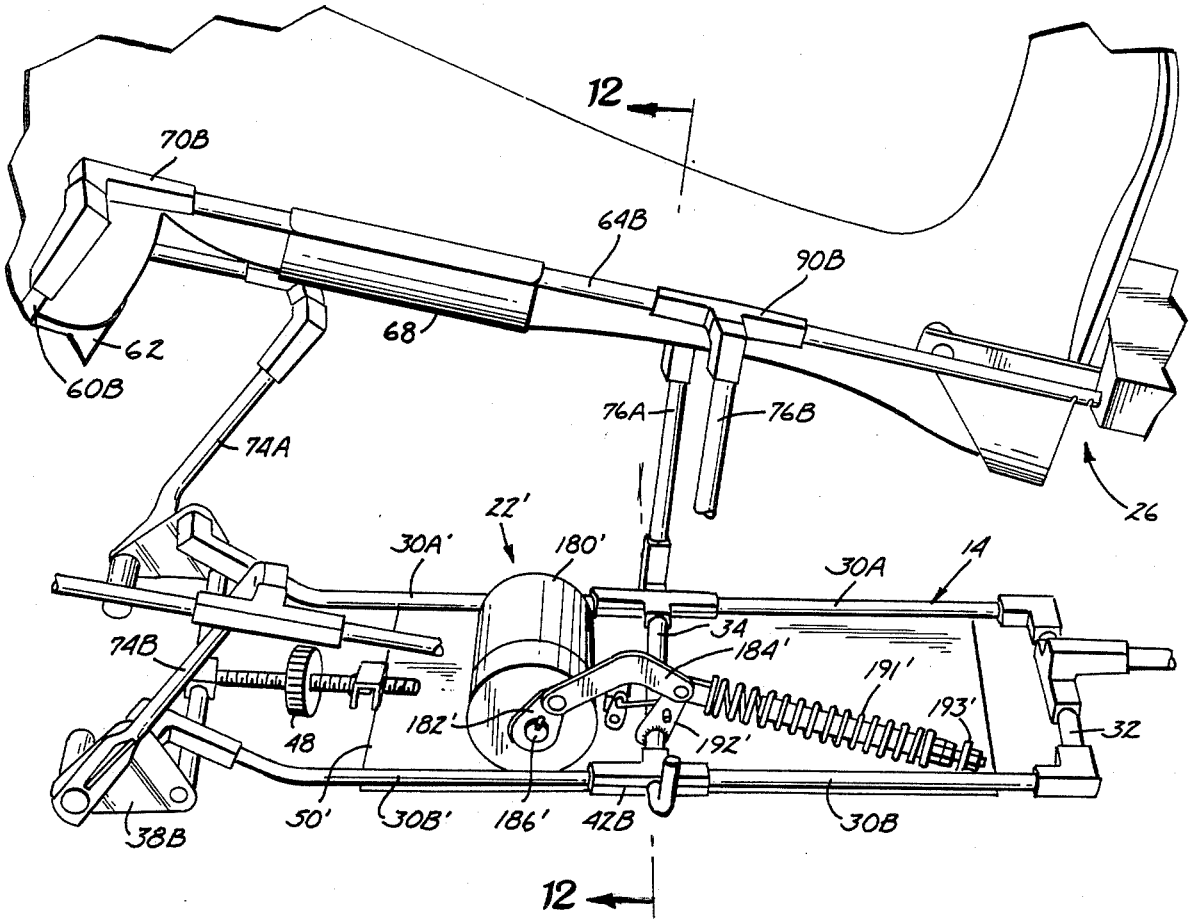
Fig.11
Fig.12
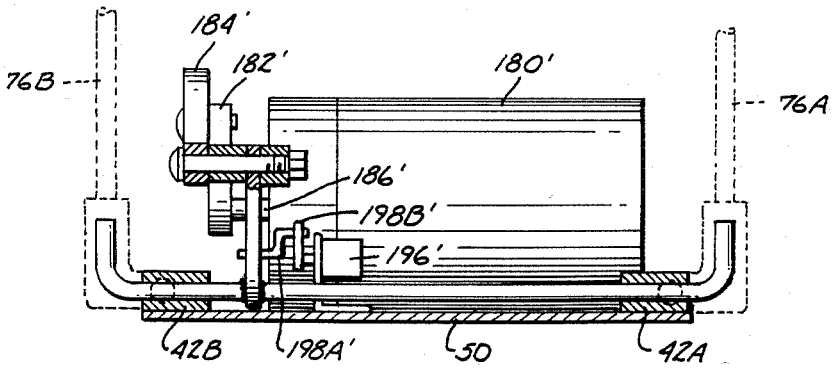

ORTHOSIS FOR LEG MOVEMENT WITH VIRTUAL HIP PIVOT

BACKGROUND OF THE INVENTION

1. Field of the Invention

This invention relates generally to an orthosis for passive or active movement of the joints of a patient's leg.

2. Description of the Prior Art

In recent years, there has been an increasing awareness of the advantages of mobilization of joints as a part of the orthopedic care which follows an injury, an illness, or a surgical procedure. A joint can stiffen rapidly as a result of immobilization, and in many cases extensive therapy is required in order to regain full use of the joint after it has stiffened.

Active motion of a joint occurs when the patient has sufficient muscle strength to flex or extend the limb without need for external applied force. In contrast, passive motion of a joint involves the use of an external force to flex and extend the limb to induce motion. Continuous passive motion of a joint following injury, illness or surgery has been found to reduce post-operative pain, decrease adhesions, decrease muscle atrophy, and enhance the speed of recovery, while minimizing other risks of immobilization such as venous stasis, thromboembolism and post-traumatic osteopenia.

Continuous passive motion devices developed in the past have, in general, included a base or frame, a femur support which supports the upper part of the leg, a tibia support which supports the lower part of the leg, a foot support which supports the foot, and a drive system. The femur support typically is pivoted with respect to the base while the tibia support pivots with respect to the femur support and is supported above the frame. Examples of this type of device are shown in the Ragon et al U.S. Pat. No. 3,450,132, the Bimler U.S. Pat. No. 3,717,144 and the Pecheux U.S. Pat. No. 4,323,060.

SUMMARY OF THE INVENTION

The present invention is an orthosis which supports the leg of a patient through a range of movement to provide exercise of the joints of the leg. The present invention includes a frame, first support means for supporting an upper portion of the leg, second support means for supporting a lower portion of the leg, and linkage means which is pivotally connected to the frame, the first support means, and the second support means. The first and second support means are pivotally connected to one another, so that the angle between the first and second support means (and thus the angle between the upper and lower portions of the leg) can be varied as the leg is moved in a reciprocal fashion between a flexion position and an extension position.

In the present invention, the linkage means guides the motion of the first and second support means through the range of movement so that the first support means pivots about a virtual pivotal axis which is proximate a hip joint of the patient. By providing a virtual hip pivot axis, the orthosis of the present invention avoids unnecessary and unwanted strain on the leg or the hip joint which can occur if the pivot axis of the first support means does not correspond to the location of the hip joint.

In preferred embodiments of the present invention, the linkage means includes first and second forward support links, first and second rear support links, and first and second drag links which together with the frame and first and second support means provide a double four-bar linkage which produces the virtual pivotal axis. The first and second forward support links are pivotally connected at their lower ends to opposite sides of the frame and at their upper ends to opposite sides of the second support means. The first and second rear support links are pivotally connected at their lower ends to opposite sides of the frame, and at their upper ends to intermediate sections of the first and second drag links, respectively. The first and second drag links are pivotally connected at their rearward ends to opposite sides of the lower end of the first support means and at their forward ends to intermediate sections of the first and second forward support links, respectively.

The orthosis of the present invention provides continuous passive motion of the leg through the range of movement through drive means which is connected to one of the links of the double four-bar linkage. In one preferred embodiment, the drive means includes a motor and a crank arm assembly which is operably connected between the motor and the forward support links to convert rotary motion of the motor to reciprocal pivotal movement of the forward support links about their pivotal connection to the frame. The pivotal movement of the forward support links is translated through the double four-bar linkage to produce reciprocal movement between a flexion end position in which the angle between the first and second support means is a minimum, and an extension end position in which the angle between the first and second support means is a maximum.

BRIEF DESCRIPTION OF THE DRAWINGS

FIGS. 11 and 12 illustrate portions of another embodiment of the present invention.

DETAILED DESCRIPTION OF THE PREFERRED EMBODIMENTS

1. Overview

Figure 1:
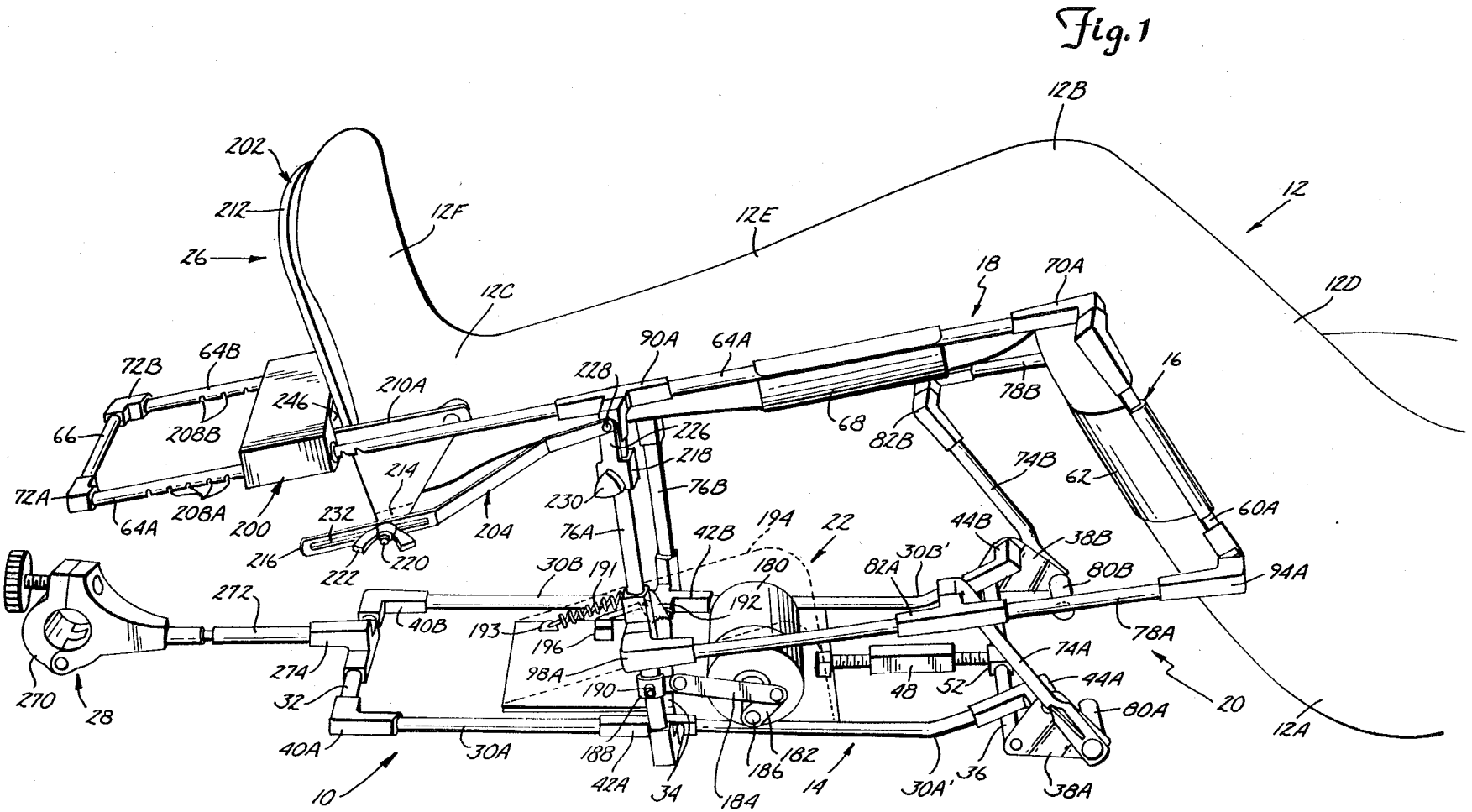
FIG. 1 is a perspective view of the orthosis of the present invention for exercising the joints of a leg of a patient.

As illustrated in the Figures, orthosis 10 of the present invention is a device which provides continuous passive motion of leg 12 of a patient to provide movement of hip 12A, knee 12B and ankle 12C. Orthosis 10 includes frame (or base) 14, first (or femur) support 16, second (or tibia) support 18, double four-bar support linkage 20, motor drive 22, foot support 26, and bed connector 28. In the embodiment shown in the figures, the orthosis 10 uses a combination of metal tubes and joints to provide a lightweight, structurally strong, yet low-cost and easy to assemble structure. It will be recognized, however, that in other embodiments of the present invention, other types of structural members and joints can be used, such as solid rectangular metal or plastic bar stock for structural members, and other forms of joint assemblies.

For the purposes of this specification, the terms "rear" or "rearward" refer to the proximal end of orthosis 10 which is closest to hip 12A, and the term "forward" refers to the distal end of orthosis 10 which is furthest from hip 12A. These terms are selected arbitrarily and simply for convenience in describing relative locations of parts.

2. Frame 14

Figure 2:
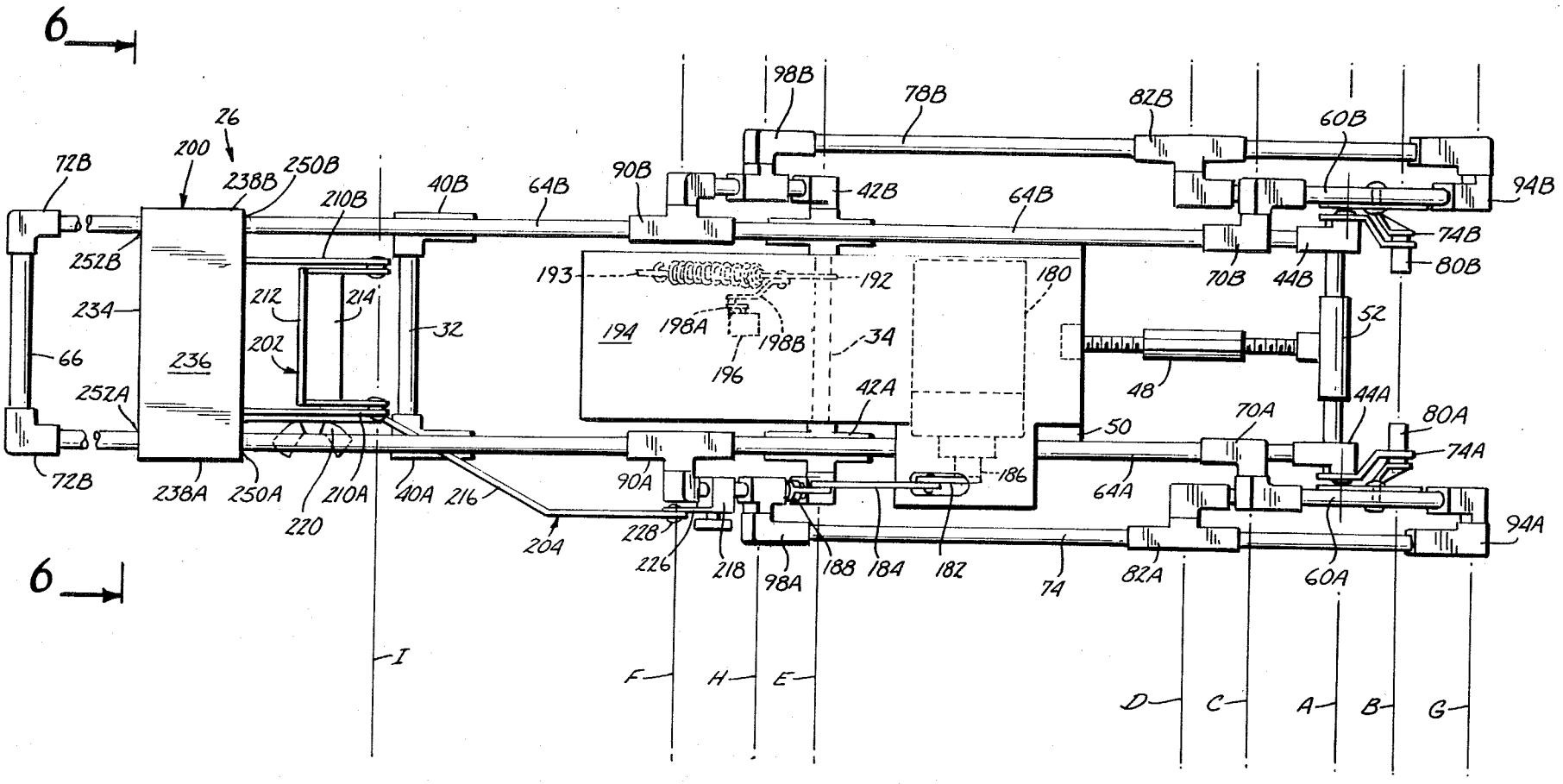
FIG. 2 is a top view of the orthosis from FIG. 1, with thigh and calf support saddles removed for clarity.
Figure 3:
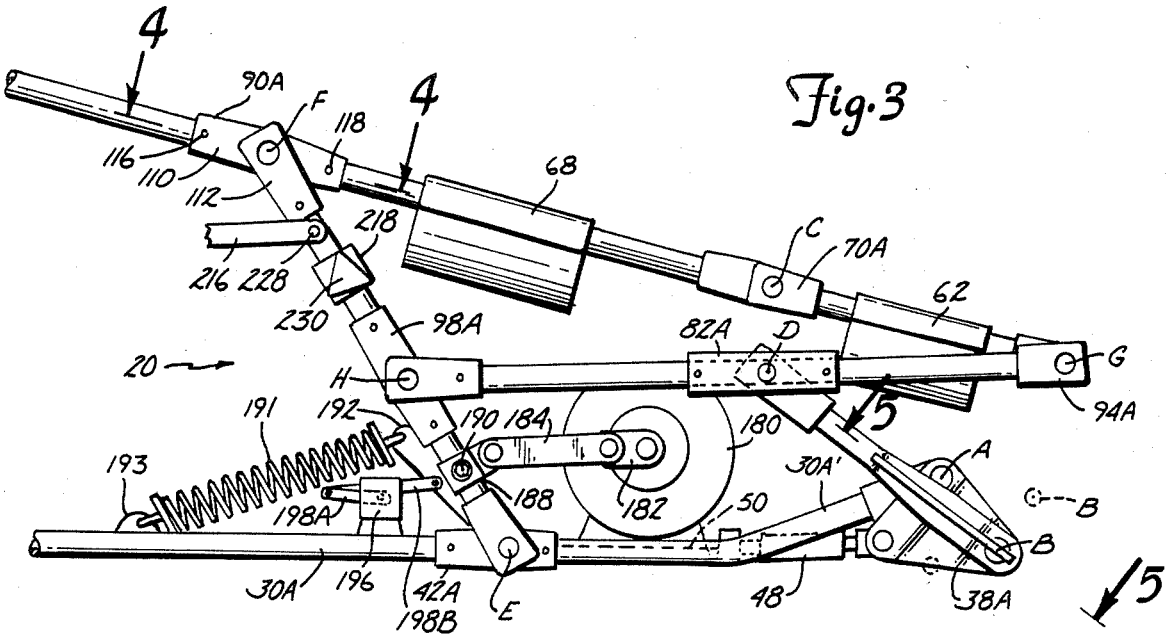
FIG. 3 is a side elevational view of a portion of the orthosis of FIG. 1.

As best illustrated in FIGS. 1–3, frame 14 is formed by a pair of generally parallel longitudinal tubes 30A and 30B, a pair of generally parallel longitudinal tubes 30A' and 30B', transverse tubes 32, 34 and 36, and triangular pivot brackets 38A and 38B. In use, frame 14 typically rests on a top surface of a bed (not shown) and is connected to the bed by bed connector 28.

Transverse tube 32 has its opposite ends connected by joints 40A and 40B to the forward ends of longitudinal tubes 30A and 30B. Joints 42A and 42B connect the rearward ends of tubes 30A and 30B to the forward ends of tubes 30A' and 30B', respectively. Transverse tube 34 extends through and is rotatably movable in joints 42A and 42B.

At the rearward end of frame 14, longitudinal tubes 30A' and 30B' have slightly upturned sections which are connected by pivot joints 44A and 44B to a first corner of triangular pivot brackets 38A and 38B, respectively. Pivot joints 44A and 44B are aligned with one another to define a horizontal pivot axis A (FIG. 2) about which triangular pivot brackets 38A and 38B can be pivoted.

Transverse tube 36 extends between pivot brackets 38A and 38B. The ends of tube 36 are fixedly attached, such as by welding, to the second corners to triangular pivot brackets 38A and 38B, respectively.

Pivot adjustment turnbuckle 48 is pivotally connected at its forward end to motor support 50 and is connected at its rearward end to connector 52 (which is rotatably mounted on transverse tube 36). Turnbuckle 48 provides an adjustable distance between motor support 50 and tube 36, and thus provides an adjustment to the position of pivot brackets 38A and 38B pivot axis A. The third corners of pivot brackets 38A and 38B define rearward support pivot axis B (FIG. 2) of four-bar linkage 20. As illustrated in FIG. 3, an increase in the distance between motor support 50 and tube 36 produced by turnbuckle 48 causes a rotation of pivot brackets 38A and 38B about axis A, which in turn causes rearward support pivot axis B to be raised. This adjustment in the position of rearward support pivot axis B is used to accommodate the variations in the length of the femur of leg 12. The longer the femur, the higher rearward support pivot axis B is raised by extending the length of turnbuckle 48.

3. First and Second Supports 16 and 18

First support 16 provides support for the upper portion of leg 12 (i.e. the femur and thigh 12D), while second support 18 provides support for the lower portion of leg 12 (i.e. the tibia and calf 12E). First support 16 includes a pair of parallel femur support tubes 60A and 60B and a U-shaped flexible thigh support saddle 62. Opposite sides of saddle 62 are attached to tubes 60A and 60B.

Second support 18 is formed by a pair of longitudinal tibia support tubes 64A and 64B, optional transverse end tube 66, and calf support saddle 68. Pivot joints 70A and 70B connect the rearward ends of tibia support tubes 64A and 64B to the upper ends of femur support tubes 60A and 60B, respectively. Pivot joints 70A and 70B are aligned with one another to define a horizontal pivot axis C (FIG. 2).

Calf support saddle 68 is attached on opposite sides to tubes 64A and 64B. The position of saddle 68 along tubes 64A and 64B is selected so that calf 12E rests in and is supported by saddle 68 as orthosis moves leg 12 through a range of movement.

Transverse end tube 66 is connected between the forward ends of tibia support tubes 64A and 64B by joints 72A and 72B, respectively. End tube 66 helps to maintain tibia support tubes 64A and 64B in a spaced apart, generally parallel relationship. In other embodiments, end tube 66 and joints 72A and 72B are omitted.

4. Double Four-Bar Linkage 20

First support 16 and second support 18 are supported and guided in their movements with respect to one another and with respect to frame 14 by double four-bar linkage 20. In the preferred embodiment shown in the figures, double four-bar linkage 20 includes a pair of parallel rear support links 74A and 74B, a pair of parallel forward support links 76A and 76B, and a pair of parallel drag links 78A and 79B. Double four-bar linkage 20 guides the movement of first and second supports 16 and 18, so that supports 16 and 18 pivot with respect to one another about pivot axis C while first support 16 pivots about a virtual pivot axis which is aligned essentially with the hip joint of leg 12. As a result, the distance from pivot axis C to the hip joint is substantially constant throughout the entire range of movement of orthosis 10, so that proper physiological movement of the hip 12A occurs as leg 12 is moved by orthosis 10.

The lower, rearward ends of rear support links 76A and 74B are pivotally connected by pivot joints 80A and 80B to the third corners of triangular pivot brackets 38A and 38B, respectively. Pivot joints 80A and 80B are aligned with one another, to define rearward support pivot axis B. As a result, rear support links 74A and 74B pivot about rearward support pivot axis B. As discussed previously, the elevation of rearward support pivot axis B is adjustable by means of turnbuckle 48 is accommodate variations in the length of the femur.

The upper, forward ends of the rear support links 74A and 74B are pivotally connected to intermediate sections of drag links 78A and 78B by joints 82A and 82B, respectively. Pivot joints 82A and 82B are aligned to define a horizontal pivot axis D (FIG. 2).

Forward support links 76A and 76B have their lower ends connected to opposite ends of transverse tube 34 (which, as described previously, extends through and is rotatable within joints 42A and 42B). Joints 42A and 42B are aligned to define horizontal pivot axis E (FIG. 2) about which the lower ends of forward support links 76A and 76B pivot. The upper ends of forward support links 76A and 76B are pivotally connected by pivot joints 90A and 90B to tubes 64A and 64B, respectively, of second support 18. Joints 90A and 90B are aligned to define horizontal pivot axis F (FIG. 2).

The rearward ends of drag links 78A and 78B are connected by pivot joints 94A and 94B to the lower, rearward ends of femur support tubes 60A and 60B, respectively. Pivot joints 94A and 94B are aligned to define horizontal pivot axis G.

The forward ends of drag links 78A and 78B are connected by pivot joints 98A and 98B to intermediate sections of forward support links 76A and 76B, respectively. Pivot joints 98A and 98B are aligned to define horizontal pivot axis H.

It can be seen, therefore, that frame 14, first and second supports 16 and 18, and double four-bar linkage 20 define seven parallel horizontal pivot axes B–H about which pivotal movement occurs during each operating cycle of orthosis 10. Of these seven horizontal pivot axes B–H, rear support pivot axis B and forward support pivot axis E remain in a fixed location during operation of orthosis 14. As described previously, the position of rear support pivot axis B is adjustable, but once its position has been selected, that position remains constant during operation of orthosis 10. The remaining five horizontal pivot axes C, D, F, G and H all move relative to one another and relative to frame 14 during each cycle of operation of orthosis 10. Throughout each cycle, however, all seven horizontal pivot axes B–H remain parallel to one another and oriented in the transverse direction.

Double four-bar linkage is, in effect, two four-bar linkages mounted one on top of the other. The lower four-bar linkage is formed by tubes 30A', 30B'; rearward support links 74A, 74B, the portions of drag links 78A, 78B between joints 82A, 82B and joints 98A, 98B; and the lower portions of forward support links 76A, 76B between joints 42A, 42B and joints 98A, 98B. The upper four-bar linkage is formed by drag links 78A, 78B; tubes 60A, 60B; tubes 64A, 64B; and the upper portions of forward support links 76A, 76B between joints 98A, 98B and joints 90A, 90B. The upper and lower portions of forward support links 76A, 76B can be integral or separate parts, but in either case the upper and lower portions are connected together in a fixed relationship.

In preferred embodiments of the present invention, the pivot joints which pivotally connect members of frame 14, first support 16, second support 18 and linkage 20 provide a separation or "stand-off" between the respective vertical planes in which the pivotable members move. For example, forward support links 76A and 76B pivot in vertical planes which are located outside of vertical planes aligned with tubes 30A, 30A' and 30B, 30B' of frame 14. Similarly, drag links 78A and 78B move in vertical planes which are located outside of the vertical planes defined by motion of forward support links 76A and 76B. The purpose of this stand-off feature provided by the various pivotal joints is to avoid "pinch points" at which a finger or hand of either the patient or attending medical personnel could be pinched as the various members pivot with respect to one another.

5. Pivot Joints 90A, 44A and 80A

Figure 4:
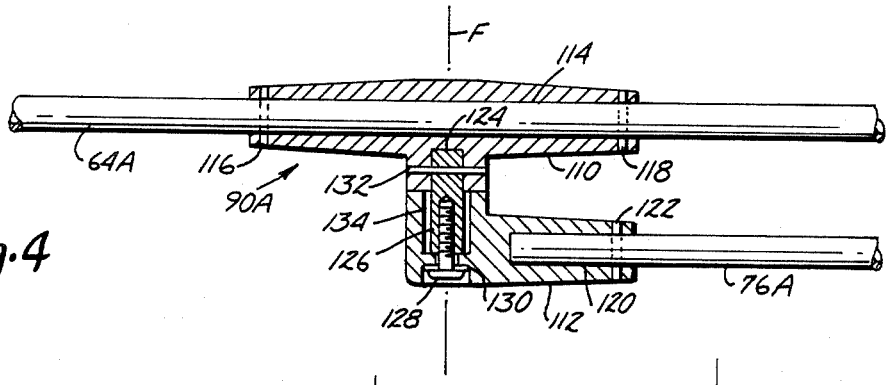
FIG. 4 is a sectional view, along section 4—4 of FIG. 3, showing the pivot joint which connects the first forward support link and the second support.
Figure 5:
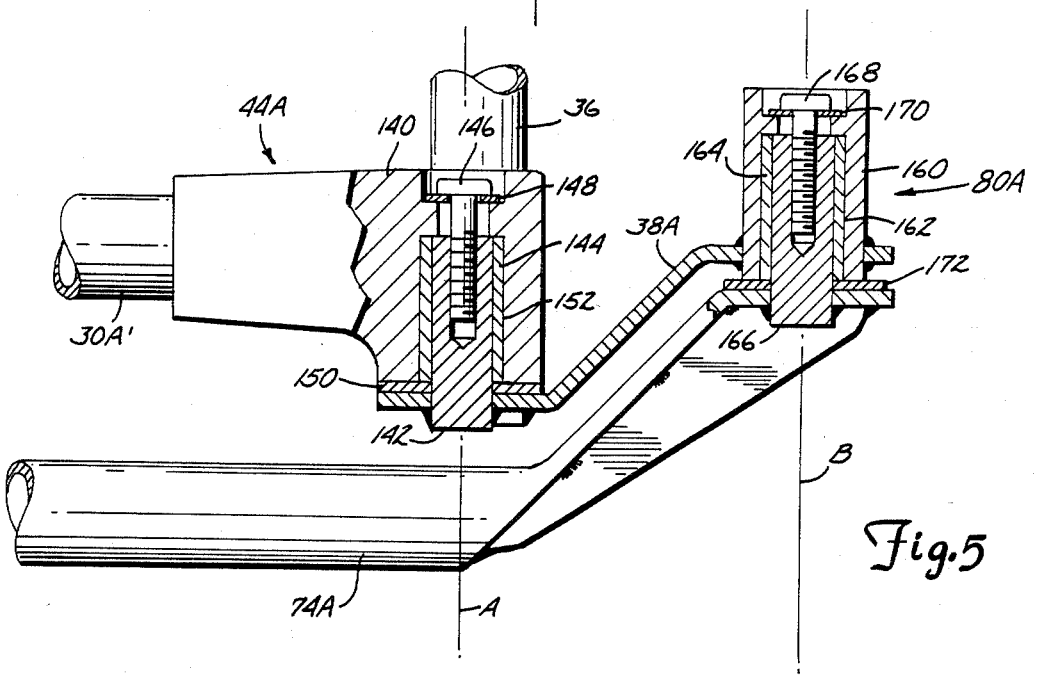
FIG. 5 is a partial sectional view, generally along section 5—5 of FIG. 3, showing two pivot joints which determine the position of the rearward support pivot axis.

FIGS. 4 and 5 show sectional views illustrating the structure of representative pivot joints used in one embodiment of the present invention. FIG. 4 illustrates joint 90A, which pivotally connects the upper end of forward support link 76A with tibia support tube 64A of second support 18.

Joint 90A includes a pair of cast metal housings 110 and 112. T-shaped housing 110 has a longitudinal passage 114 through which tube 64A extends. Pins 116 and 118 extend through opposite ends of T-shaped housing 110 and through tube 64A to connect housing 110 to tube 64A in a fixed relationship.

One leg of L-shaped housing 112 has a bore 120 into which the upper end of forward support link 76A is inserted. Pin 122 extends through housing 112 and tube 76A to connect together housing 112 and forward support link 76A.

L-shaped housing 112 and T-shaped housing 110 are pivotally connected together by bearing shaft 124, bearing sleeve 126, screw 128, washer 130 and pin 132. Bearing shaft 124 (which in another embodiment is an integral part of housing 110) has one end positioned within bearing sleeve 126, and its opposite end extending into T-shaped housing 110, where it is secured by pin 132. Bearing sleeve 126 is press-fit into bore 134 of housing 112, and provides relative rotation between housing 112 and bearing shaft 124. Screw 128 connects together bearing shaft 124 and housing 112, while permitting rotation about pivot axis F.

Pivot joint 44A shown in FIG. 5 provides a pivotal connection about axis A between rearward end upturned section 30A' of tube 30A and the second corner of triangular pivot plate 38A. The connection of section 30A' and joint 44A is not shown, but is generally similar to the connection of forward support link 76A and housing shown in FIG. 4.

Pivot joint 44A includes cast L-shaped housing 140, bearing shaft 142, bearing sleeve 144, screw 146, and washers 148 and 150. Bearing shaft 142 has one end welded to pivot plate 38A, and its opposite end extending into housing 140. Bearing sleeve 144 is press-fit into bore 152 of housing 140, and provides pivotal movement between bearing shaft 142 and housing 140. Bearing shaft 142 and housing 140 are connected together by screw 146. Pivot joint 80A, which connects pivot plate 38A and rear support link 74A rearward for pivotal movement about pivot axis B, has a generally similar type of construction. Housing 160 is attached to pivot plate 38A by welding and has a bore 162 into which bearing sleeve 164 is press-fit. Bearing shaft 166 has one end positioned within bearing sleeve 164, and its other end attached by welding to the lower, rear end of rear support link 76A. Screw 168 and washers 170 and 172 hold together housing 160 and bearing shaft 166, while permitting pivotal movement about rearward support pivot axis B.

6. Motor Drive 22

Due to the various pivotal connections between frame 14, first support 16, second support 18 and linkage 20, the pivotal movement of the rearward support links 74A and 74B or the forward support links 76A and 76B will cause movement of all of the movable members of supports 16 and 18 and linkage 20. In the embodiment shown in FIGS. 1–3, motor drive 22 applies drive force to forward support link 76A to cause reciprocal motion or orthosis 10.

In this preferred embodiment, motor drive 22 includes electric motor 180 (which preferably includes a gear train) and a crank arm assembly formed by crank 182 and connecting link 184. Motor 180 is supported by motor support 50, which is connected to frame 14. Crank 102 has one end connected to drive shaft 86 of motor 180, and its opposite end pivotally connected to link 184, The opposite end of link 184 is connected by bracket 188 and set screw 190 to forward support link 76A at a position between joints 42A and 98A. Compression spring 191 is connected between tab 192 (which is fixed to transverse tube 34) and tab 193 to bias constantly tab 192 rearward with respect to pivot axis E. Motor 180 and electrical control circuitry (not shown) are located within housing 194.

As drive shaft 186 rotates, this rotary drive is converted to an oscillating drive by crank 182 and link 184. The particular position by bracket 188 on forward support link 186 determines the angular extent of movement of forward support link 76A about forward support pivot axis 88. Set screw 190 clamps bracket 18 in the selected position on forward support link 76A. The further bracket 188 is positioned from joint 42A (and thus from forward support pivot axis E) the greater the amount of angular movement of forward support link 76A about forward support pivot axis E during one cycle of motor drive shaft 186.

Compression spring 191 applies a bias force through tab 192 and tube 34 to forward support links 76A and 76B in the rearward direction. During the portion of the operating cycle in which leg 12 is being extended by movement of orthosis 10, compression spring 191 stores energy. This stored energy is used during the other half of the operating cycle to help counteract the weight of leg 12 as it is being lifted and flexed by orthosis 10.

The use of compression spring 191 to apply a bias force decreases the additional load on motor 180 during the flexion portion of the operating cycle by at least partially counteracting the weight of leg 12. With the decreased power demands on motor 180 due to compression spring 191, the size of motor 180 can be decreased, thus reducing cost and size of motor 180. Conversely, the reduced power requirements yield a longer operating life for the same size motor 180.

As further shown in FIGS. 1–3, potentiometer 196 is connected through links 198A and 198B to tab 192. The output of potentiometer 196 is an analog electrical signal which varies with angular position of tb 92 (and thus the angular position of forward support links 76A, 76B). This output is used to control operation of motor 180 and/or neuro-muscular stimulation devices (not shown) which are used in conjunction with orthosis 10.

7. Foot Support 26

Figure 6:
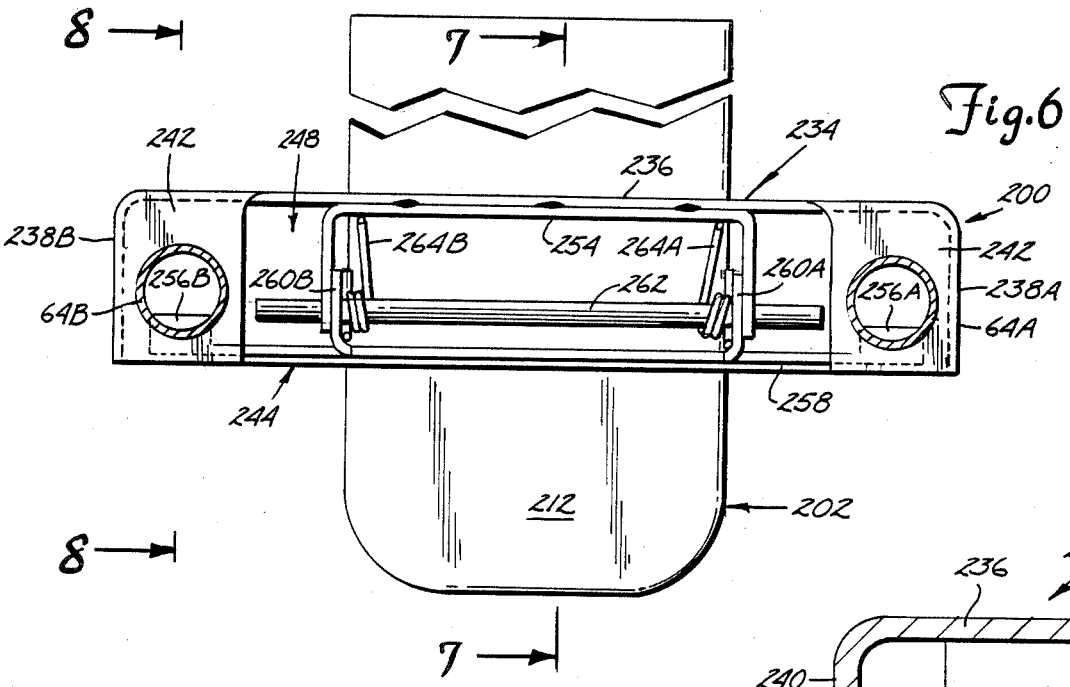
FIG. 6 is a sectional view along section 6—6 of FIG. 2, showing the foot support of the orthosis.
Figure 8:
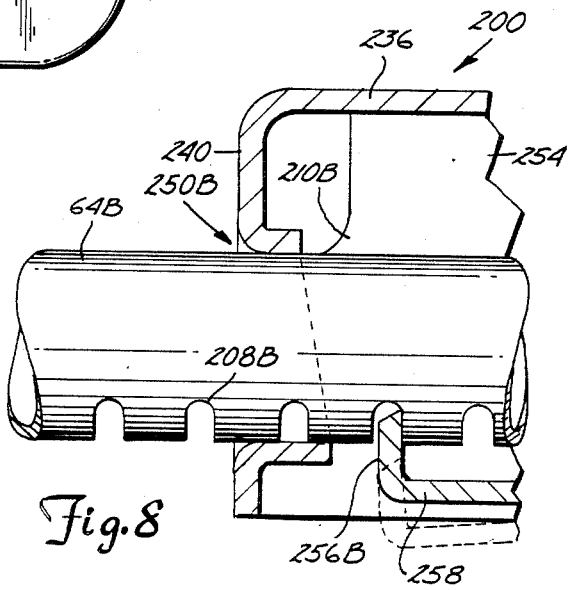
FIG. 8 is a sectional view along section 8—8 of FIG. 6.
Figure 7:
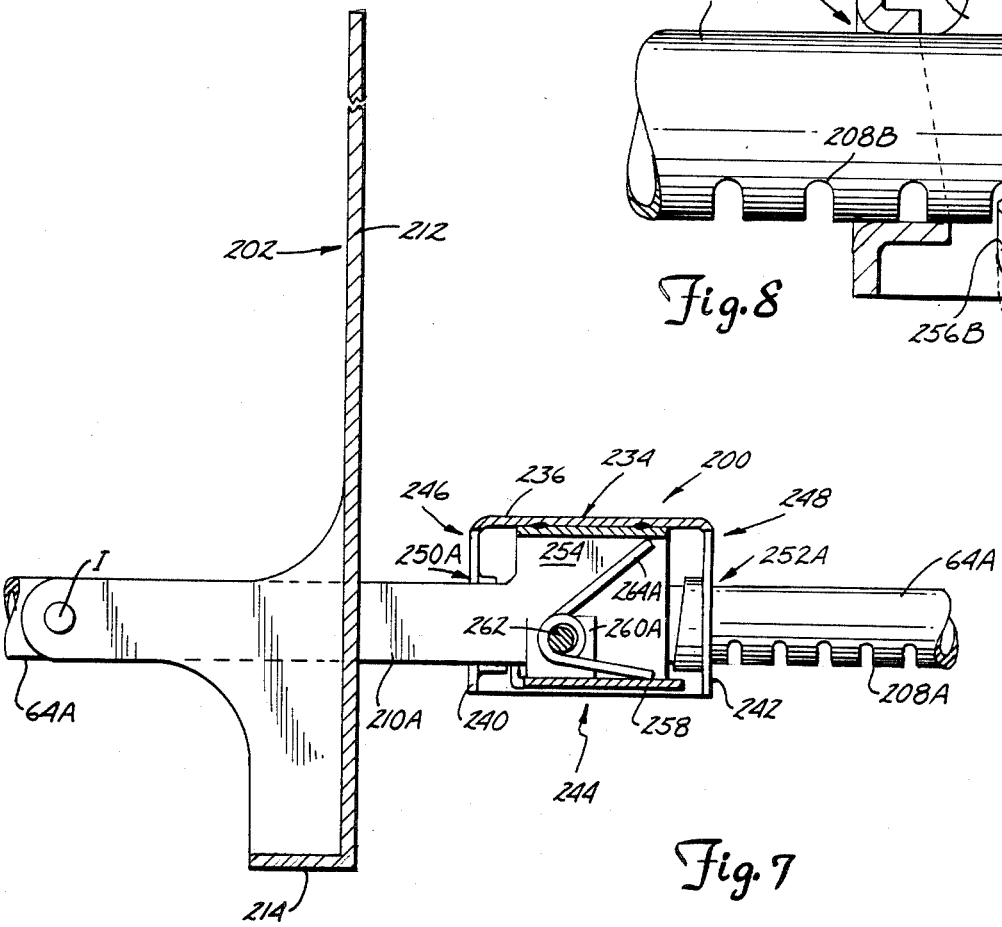
FIG. 7 is a sectional view along section 7—7 of FIG. 6.

Foot support 26 is illustrated in FIGS. 1 and 2, and also in partial sectional views in FIGS. 6, 7 and 8. In this preferred embodiment, foot support 26 includes positioning clamp 200, foot and heel support 202, and linkage 204.

Clamp 200 is slidable on tubes 64A and 64B to a plurality of different fixed locations which are defined by notches 208A and 208B located on the lower surfaces of tubes 64A and 64B. Clamp 200 engages one pair of notches 208A, 208B to define the longitudinal position of foot and heel support 202, and allows a wide range of different longitudinal positions to accomodate tibia of different lengths.

A pair of arms 210A and 210B extend out from opposite sides of clamp 200. Foot and heel support 202 is pivotally connected to arms 210A and 210B to permit pivotal movement of support 202 about horizontal pivot axis I (FIG. 2), which passes approximately through the joint of ankle 12C. As best shown in FIG. 7, support 202 includes foot support plate 212 which engages the sole of foot 12F, and heel support flange 214 on which the heel of foot 12F rests.

Linkage 204 includes connecting link 216, clamp 218, threaded stud 220 and wingnut 222. Link 216 is pivotally connected at its rearward end to upstanding ear 226 of clamp 218 at pivot point 228. The position of clamp 218 on forward support link 76A is adjustable. When the desired position has been determined, set screw 230 holds clamp 218 in that desired position.

At its forward end, link 216 has a longitudinal slot 232 through which stud 220 projects. When wingnut is tightened on stud 220 to connect support 202 to linkage 204, the distance between stud 220 and pivot point 228 remains constant. The extent of pivotal movement of support 202 about pivot axis I during the reciprocal movement of orthosis 10 depends upon the displacement of pivot point 228 with respect to pivot axis H. The larger the distance between pivot axis H and pivot point 228, the larger the extent of pivotal movement of support 202 about pivot axis I. Ear 226 of clamp 218 permits pivot point 228 to be aligned with pivot axis H, if desired, which results in no pivotal movement of support 202. Adjustment of the position of clamp 218 away from joint 90A increases the separation of pivot point 228 and pivot axis H to increase the extent of pivotal movement about pivot axis I.

By loosening wingnut 222, pivotal movement of support 202 is permitted despite linkage 204, since the distance between stud 220 and pivot point 228 is no longer maintained constant. The particular adjustments of clamp 228 and wingnut 222 depend upon the desired amount of continuous passive motion therapy needed for the ankle joint.

FIGS. 6, 7 and 8 show clamp 200 in further detail. In this preferred embodiment, clamp 200 provides positive positioning of foot support 26 along tubes 64A and 64B, and permits this position to be changed quickly and easily with one hand.

Clamp 200 includes clamp housing 234, which has a top 236, a pair of generally parallel sides 238A and 238B, ends 240 and 242, and open bottom 244. Ends 240 and 242 have openings 2546 and 248.

Rearward end 240 of housing 234 carries a pair of flanged circular openings 250A and 250B, while forward surface 242 carries a similar pair of flanged openings 252A and 252B. Tube 64A extends through opening 250A and opening 252A, while tube 64B extends through opening 250B and opening 252B.

Bracket 254 is attached to the inner surface of top 236 of clamp housing 234. Arms 210A and 210B are an integral part of bracket 254, and extend rearwardly out of clamp housing 200 through opening 246.

The location of clamp 200 along tubes 64A and 64B is determined by the engagement of pawls 256A and 256B with a set of notches 208A and 208B on the underside of tubes 64A and 64B, respectively. Pawls 256A and 256B are located at the rearward ends of release bar 258. A pair of upstanding ears 260A and 260B extend upward from release bar 258 and have a pivot pin 262 which extends through them in a transverse horizontal direction to pivotally connect release bar 258 to bracket 254.

Springs 264A and 264B provide a spring bias force which urge pawls 256A and 256B upward into engagement with notches 208A and 208B, respectively.

By grasping the forward ends of clamp housing top 236 and release bar 258 and squeezing them together, the nurse or therapist causes release bar 258 to be pivoted to move pawl 256A and 256B out of engagement with notches 208A and 208B, as illustrated in dashed lines in FIG. 8. In this condition, clamp 200 can be moved longitudinally along tubes 64A and 64B until the desired position of support 202 is attained. At that point, release bar 258 is permitted to return to its spring-biased normal position, with pawls 256A and 256B engaging a pair of notches 208A and 208B.

8. Bed Connector 28

As illustrated in FIG. 1, orthosis 10 is connected to the end of the hospital bed (not shown) by bed connector 28. In the particular embodiment shown in FIG. 1, bed connector 28 includes clamp 270, which is mounted on a forward end of tube 272. The rearward end of tube 272 is connected by pivot joint 274 to transverse tube 32 of frame 14. Pivot joint 274 permits angular rotation, in a generally horizontal plane, of tube 272.

9. Operation of Orthosis 10

FIGS. 9A and 9B, and FIGS. 10A and 10B illustrate the operation of orthosis 10 for two different positions of rear support pivot axis B.

Figure 9A:
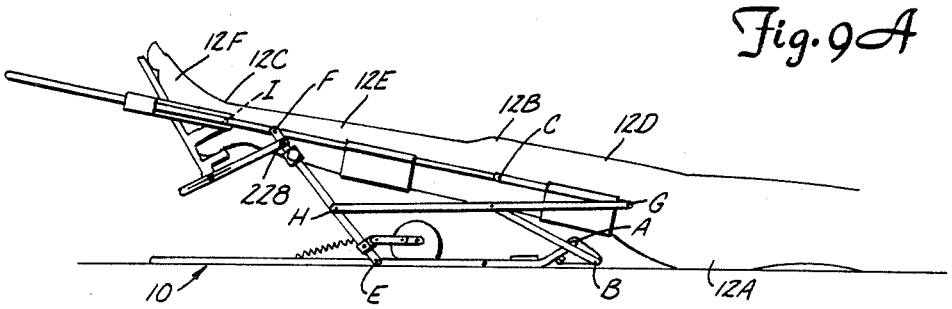
FIGS. 9A and 9B show the extension and flexion end positions of reciprocal movement of the orthosis with the rearward support pivot axis at its lowermost adjustable position.
Figure 9B:
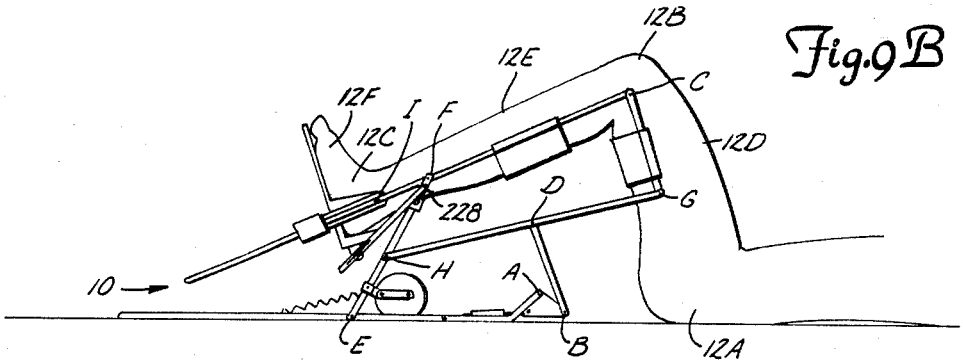
Figure 10A:
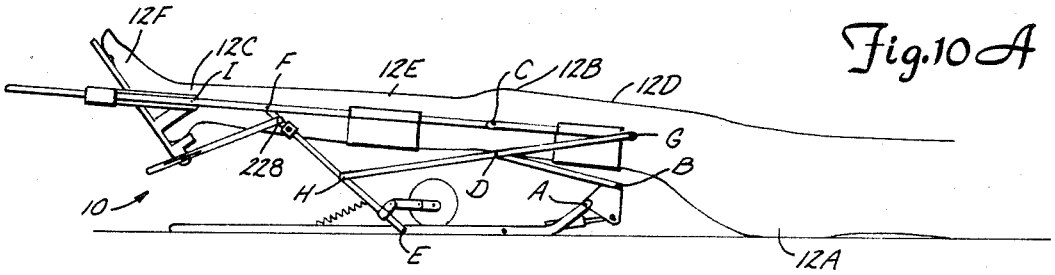
FIGS. 10A and 10B show the extension and flexion end positions of reciprocal movement of the orthosis with the rearward support pivot axis at its uppermost adjustable position.
Figure 10B:
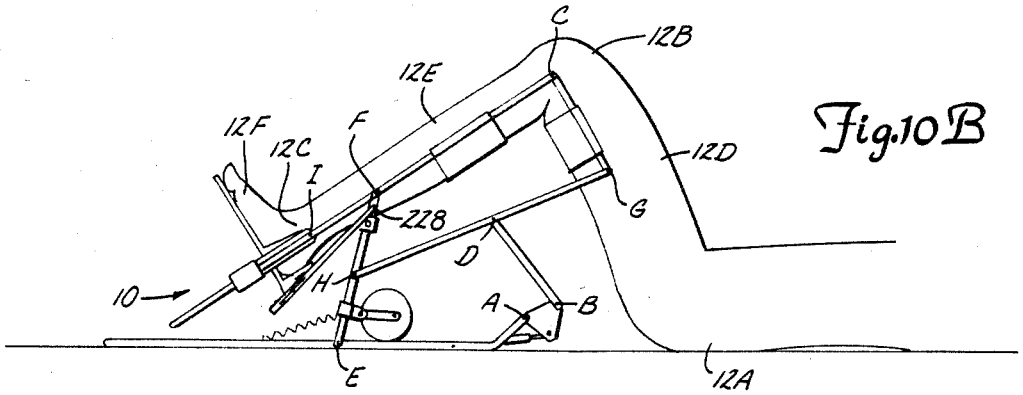

In FIGS. 9A and 9B , the extension and flexion end points of movement of orthosis 10 are shown with rear support pivot axis B at its lowermost position. In FIGS. 10A and 10B, the extension and flexion end point positions of orthosis 10 are shown with rear support pivot axis B at its uppermost position. This ability to change the location of rear support pivot axis B allows orthosis 10 to be used with legs of widely varying length.

10. The Alternative Embodiment of FIGS. 11 and 12

FIGS. 11 and 12 show another embodiment of the present invention, which differs from the embodiments shown in FIGS. 1–3 primarily in the construction of the motor drive 22. This embodiment is generally similar to the embodiment shown in FIG. 1, and similar elements are designated with similar reference characters.

FIG. 11 is a perspective view from the opposite side of that shown in FIG. 1. In this embodiment, motor drive 22' includes electric motor 180' and a crank arm assembly formed by crank 182' and connecting link 184'. Motor 180' is connected to motor support 50', which in turn is connected to frame 14. Crank 182' has one end connected to drive shaft 186' of motor 180, and its opposite end pivotally connected to link 184'. The opposite end of link 184' is connected to tab 192', which is fixedly connected to transverse tube 34. In turn, transverse tube 34 is fixedly connected to the lower ends of forward support links 76A and 76B. Compression spring 191' is connected to tab 192' at one end and to tab 193' at its opposite end. Compression spring 191' provides a bias force to drive tab 192' in the rearward direction.

In this embodiment, drive shaft 186' rotates in two directions, and the rotary movement is converted to an oscillating drive by crank 182' and link 184'. The particular position of the connection between link 184' and drive tab 192' determines the angular extent of movement of forward support links 76A and 76B about forward support pivot axis E.

Also shown in FIGS. 11 and 12 are potentiometer 196' and links 198A' and 198B'. As in the embodiment shown in FIGS. 1–3, potentiometer 196 provides an analog position signal which indicates the angular position of forward support links 76A and 76B, and thus the position of supports 16 and 18.

10. Conclusion

As discussed previously, orthosis 10 of the present invention provides a virtual pivot axis for first support 16 which is located near the hip joint. Although this virtual pivot moves slightly during the reciprocal movement of orthosis 10, it remains located near the hip joint at all times. With the virtual hip pivot provided by the present invention, orthosis 10 is capable of being positioned in the bed more distally relative to the patient. Orthosis 10 also allows more trunk mobility for daily nursing care and patient comfort.

Although the present invention has been described with reference to preferred embodiments, workers skilled in the art will recognize that changes may be made in form and detail without departing from the spirit and scope of the invention.

What is claimed is:

1. A leg exercise apparatus for supporting a leg of a patient through a range of movement, the apparatus comprising:

a frame;

femur support means indirectly connected to the frame for supporting an upper portion of the leg through the range of movement;

tibia support means for supporting a lower portion of the leg through the range of movement, the tibia support means being pivotally connected to the femur support means; and linkage means pivotally connected to the frame, the femur support means and the tibia support means at distinct points thereon for guiding motion of the femur and tibia support means through the range of movement so that the femur support means pivots about essentially a virtual pivot axis which is proximate a hip joint of the patient and is spatially separated from the frame, the femur support means, the tibia support means and the linkage means.

2. The apparatus of claim 1 and further comprising:

drive means for providing a drive force which causes reciprocal movement of the femur and tibia support means through the range of movement.

3. The apparatus of claim 2 wherein the drive means is operably connected to the linkage means to provide the drive force through the linkage means to the femur and tibia support means.

4. The apparatus of claim 3 wherein the drive means causes reciprocal movement of the femur and tibia support means between an extension end position in which an angle between the femur and tibia support means is a maximum and a flexion end position in which the angle is a minimum.

5. The apparatus of claim 4 and further comprising bias spring means operably connected between the frame and the linkage means for storing energy during a first portion of a reciprocal operating cycle in which the femur and tibia support means move from the flexion to the extension end position, and for delivering the energy stored during a second portion of the reciprocal operating cycle in which the femur and tibia support means move from the extension to the flexion end position to at least partially counteract weight of the leg as it is being lifted and flexed.

6. The apparatus of claim 5 wherein the bias spring means comprises a compression spring.

7. The apparatus of claim 2 wherein the drive means comprises a motor for causing rotation of a drive shaft, a crank connected to the drive shaft, and a connecting link connected between the crank and the linkage means for converting rotation of the drive shaft to motion of the femur and tibia support means.

8. A leg exercise apparatus for supporting a leg of a patient through a range of movement, the apparatus comprising:

a frame;

femur support means for supporting an upper portion of the leg through the range of movement;

tibia support means for supporting a lower portion of the leg through the range of movement, the tibia support means being pivotally connected to the femur support means; and linkage means pivotally connected to the frame, the femur support means and the tibia support means for guiding motion of the femur and tibia suport means through the range of movement so that the femur support means pivots about essentially a virtual pivot axis proximate a hip joint of the patient; wherein the linkage means comprises:

first and second generally parallel forward support links pivotally connected to lower ends to the frame and pivotally connected at upper ends to the second support means; and first and second generally parallel drag links having rearward ends pivotally connected to the first support means and forward ends pivotally connected to intermediate sections of the first and second forward support links, respectively; and first and second rear support links having lower end pivotally connected to the frame and having upper end pivotally connected to intermediate sections of the first and second drag links, respectively.

9. The apparatus of claim 8 wherein the femur support means comprises first and second generally parallel femur support members having rearward and forward ends, and a thigh support connected therebetween; the first and second femur support members being connected at their rearward ends to the rearward ends of the first and second drag links, respectively.

10. The apparatus of claim 9 wherein the tibia support means comprises first and second generally parallel tibia support members having rearward and forward ends, and a calf support connected therebetween; the first and second tibia support members having their rearward ends pivotally connected to the forward ends of the first and second femur support members, respectively.

11. The apparatus of claim 8 and further comprising:

a shaft fixedly connected at opposite ends to the lower ends of the forward support links;

a tab fixedly connected to the shaft;

a motor with a rotating drive shaft;

a crank connected to the drive shaft; and a connecting link connected between the crank and the tab for converting rotation of the drive shaft to rotation of the shaft and thus to reciprocal motion of the femur and tibia support means.

12. The apparatus of claim 8 and further comprising:

means for adjusting an elevation of the privotal connection of the first and second rear support links to the frame to accommodate different femur lengths.

13. An orthosis for a leg of a patent comprising:

a frame;

first and second femur support members having rearward and forward ends;

a thigh support connected between the first and second femur support members;

first and second tibia support members having rearward and forward ends, the rearward ends of the first and second tibia support members being pivotally connected to the forward ends of the first and second femur support members to define a first generally parallel movable pivot axis;

a calf support connected between the first and second tibia support members;

first and second forward support links pivotally connected at a lower end to the frame for pivotal movement about a generally horizontal forward support pivot axis and pivotally connected at upper ends to the first and second tibia support members, respectively, to define a second generally horizontal movable pivot axis;

first and second drag links pivotally connected at rearward ends to the first and second femur support members to define a third generally horizontal movable pivot axis, and pivotally connected at forward ends to intermediate sections of the first and second forward support links, respectively, to define a fourth generally horizontal movable pivot axis; and first and second rear support links having lower ends pivotally connected to the frame for pivotal movement about a generally horizontal rear support pivot axis and having upper ends pivotally connected to intermediate sections of the first and second drag links to define a fifth generally horizontal movable pivot axis.

14. The apparatus of claim 13 and further comprising:

drive means for providing a drive force which causes reciprocal movement of the femur and tibia support members.

15. The apparatus of claim 14 wherein the drive means is operably connected to the forward support links to provide the drive force to the femur and tibia support means.

16. The apparatus of claim 15 wherein the drive means causes reciprocal movement of the femur and tibia support members between an extension end position in which an angle between the femur support members and tibia support members is a maximum and a flexion end position in which the angle is a minimum.

17. The apparatus of claim 16 and further comprising bias spring means operably connected between the frame and the forward support links for storing energy during a first portion of a reciprocal operating cycle in which the femur and tibia support members move from the flexion to the extension end position, and for delivering the energy stored during a second portion of the reciprocal operating cycle in which the femur and tibia support members move from the extension to the flexion end position to at least partially counteract weight of the leg as it is being lifted and flexed.

18. The apparatus of claim 15 wherein the drive means comprising:

a shaft fixedly connected at opposite ends to the lower ends of the forward support links;

a tab fixedly connected to the shaft;

a motor with a rotating drive shaft;

a crank connected to the drive shaft; and a connecting link connected between the crank and one of the tabs for converting rotation of the drive shaft to rotation of the shaft and thus to reciprocal motion of the femur and tibia support members.

19. The apparatus of claim 13 and further comprising:
means for adjusting an elevation of the rear support pivot axis to accommodate different femur lengths.

20. A leg exercise apparatus for supporting a leg of a patient through a range of movement, the apparatus comprising:
a frame;
femur support means for supporting an upper portion of the leg through the range of movement;
tibia support means for supporting a lower portion of the leg through the range of movement, the tibia support means being pivotally connected to the femur support means; and
a plurality of links connected to form with the frame, the feumr support means and the tibia support means a double four-bar linkage which guides motion of the femur and tibia support means through the range of movement so that the femur support means pivots about essentially a virtual pivot axis proximate a hip joint of the patient.

* * * * *

UNITED STATES PATENT AND TRADEMARK OFFICE

CERTIFICATE OF CORRECTION

PATENT NO. : 4,566,440

DATED : January 28, 1986

INVENTOR(S) : John M. Berner, Patricia M. Derus, James P. Berner

It is certified that error appears in the above-identified patent and that said Letters Patent is hereby corrected as shown below:

In Claim 8, lines 27 and 29 (column 11, lines 33 and 35), insert "s" after "end". The lines should read "ends".

Signed and Sealed this

*Third* Day of *June 1986*

[SEAL]

*Attest:*

DONALD J. QUIGG

*Attesting Officer*

*Commissioner of Patents and Trademarks*